US005671517A

United States Patent [19]

Gourley

[11] Patent Number: 5,671,517

[45] Date of Patent: Sep. 30, 1997

[54] SHOE LACE SAFETY GUARD

[76] Inventor: Mervin Gourley, 9312 Burnet Ave., North Hills, Calif. 91343

[21] Appl. No.: 711,106

[22] Filed: Sep. 9, 1996

[51] Int. Cl.[6] ..... A43B 23/26; A43B 23/00; A43B 11/00

[52] U.S. Cl. ..... 24/712.1; 36/136; 24/306

[58] Field of Search ..... 24/306, 712.1, 24/712.3, 712, 715.4, 713, 713.2; 36/136, 72 R

[56] References Cited

U.S. PATENT DOCUMENTS

| | | | |
|---|---|---|---|
| 1,371,637 | 3/1921 | Meredith | 24/712.3 |
| 2,022,554 | 11/1935 | Williams | 24/712.3 X |
| 3,473,198 | 10/1969 | Meier | 24/712.3 |
| 4,377,913 | 3/1983 | Stone | 36/99 |
| 4,514,882 | 5/1985 | Lavielle | 24/712.1 X |
| 4,630,383 | 12/1986 | Gamm | 36/136 |
| 4,805,321 | 2/1989 | Toukel | 36/54 |
| 4,823,426 | 4/1989 | Bragga | 36/136 X |
| 5,094,016 | 3/1992 | DiVito | 36/136 |
| 5,154,011 | 10/1992 | Holzl et al. | 36/117 |
| 5,156,190 | 10/1992 | Smyth | 24/712.3 X |
| 5,311,679 | 5/1994 | Birch, Sr. | 36/136 |
| 5,355,596 | 10/1994 | Sussmann | 36/50.1 |
| 5,357,691 | 10/1994 | Hyde et al. | 36/54 |
| 5,421,106 | 6/1995 | Emrick | 36/136 |
| 5,426,872 | 6/1995 | Hayes | 36/120 |
| 5,459,947 | 10/1995 | Lasher | 36/54 |
| 5,496,612 | 3/1996 | Ransbottom | 36/136 X |
| 5,566,477 | 10/1996 | Mathis et al. | 36/136 X |

*Primary Examiner*—Peter M. Cuomo
*Assistant Examiner*—Robert J. Sandy
*Attorney, Agent, or Firm*—Dennis W. Beech

[57] ABSTRACT

The shoe lace safety guard is a device to cover and retain the shoe laces to prevent inadvertent snagging or other interference with the laces when wearing shoes. An inner fastener element is attached by a tab to the shoe lace at the furthest lace away from the point at which the laces are tied. The shoe laces are then tied by a bow over the inner fastener element. An outer fastener element attached at a fold is then folded over onto the inner fastener element and retained by a hook and loop material to cover and retain the laces. The outer fastener element may have hook and loop material to allow attachment of emblems, reflectors and other objects.

6 Claims, 2 Drawing Sheets

SHOE LACE SAFETY GUARD

BACKGROUND OF THE INVENTION

1. Field of the Invention

This invention relates to devices placed on the laces of shoes to prevent inadvertent snagging of the laces. The new device provides as simple means to attach to the shoe laces or the shoes, to secure the shoe laces and to attach an emblem, safety device or other object.

2. Description of Related Art

There are currently in use various devices for protecting the laces of shoes. The most common include ski boots which have lacing to tighten the boots and a flap or tongue which folds up or over the laces to completely cover them. Such covering flaps are normally quite large relative to the laces to be covered and in many cases form further reinforcement for the wearer of the boot.

Other devices have been developed for attachment over shoe laces or on shoe laces which may be used for wiping shoes, for attaching objects or which have pockets. An example of such devices is that represented by U.S. Pat. No. 5,459,947 which has a strip for sliding under the shoe laces and a flap to fold over the top of the laces. The flap or tongue may have decorative indicia silkscreened thereon.

The present invention provides a means to attach the safety guard to a link of the shoe lace. The safety guard is then retained at a fold by tying the shoe laces such as in the typical bow. An outer cover then folds over the tied laces to hold them by means of hook and loop retainers. This simple attachment to existing shoe laces and retention of the loose tied portion of the laces provides for safety in preventing inadvertent snagging or other interference with the shoe laces. The safety guard may have an attachment means on its outer surface for attachment of emblems, safety reflectors or other objects. The safety guard may also be attached directly to the shoe.

SUMMARY OF THE INVENTION

A primary objective of the present invention is to provide a safety guard to cover and retain shoe laces. Another object is to provide a safety guard to which objects to be viewed may be attached.

In accordance with the description presented herein, other objectives of this invention will become apparent when the description and drawings are reviewed.

DESCRIPTION OF THE PREFERRED EMBODIMENT

The safety guard consists of an inner fastener element and an outer fastener element joined at a fold. There are hook and loop fasteners for attachment and a tab with a snap attachment for retention to the shoe laces of a shoe. The outer fastener element on the outer fastener surface may have hook and loop material for attachment of an emblem or other device. The safety guard is generally sized to cover the shoe laces.

Figure 7:
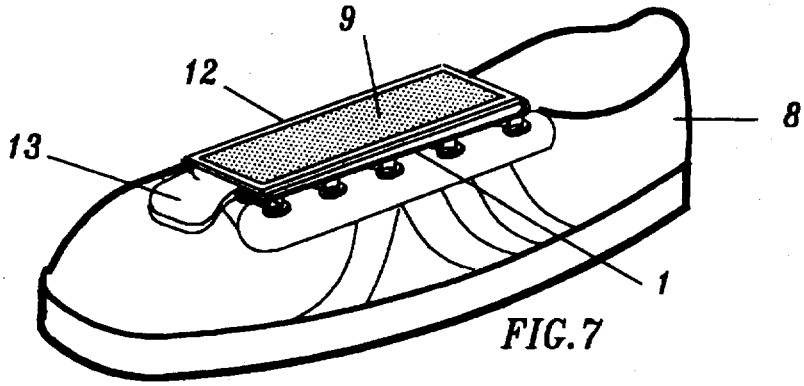
FIG. 7 illustrates a perspective view of the safety guard attached to the shoe and covering the laces.

Referring to FIGS. 1 through 5, a safety guard (1) has an inner fastener element (2) attached at a fold (3) to an outer fastener element (4). There is also a tab (5) attached to the inner fastener element (2) at an edge opposite the fold (3). The tab (5) and inner fastener element (2) have cooperatively located a snap (6) such that when the tab (5) is folded around a shoe lace (7) it may be snapped to the inner fastener element (2) to retain the safety guard (1) to the laces (7) and thereby to the shoe (8). An alternate method of attachment would be to attach the shoe tab (13) to the shoe (8) by stitching or other attachment means as illustrated in FIG. 7.

The inner surface (9) of the inner fastener element (2) and outer fastener element (4) have a hook and loop material (9) such that when elements (2, 4) are folded against each other they are retained by the hook and loop material (9).

Figure 1:
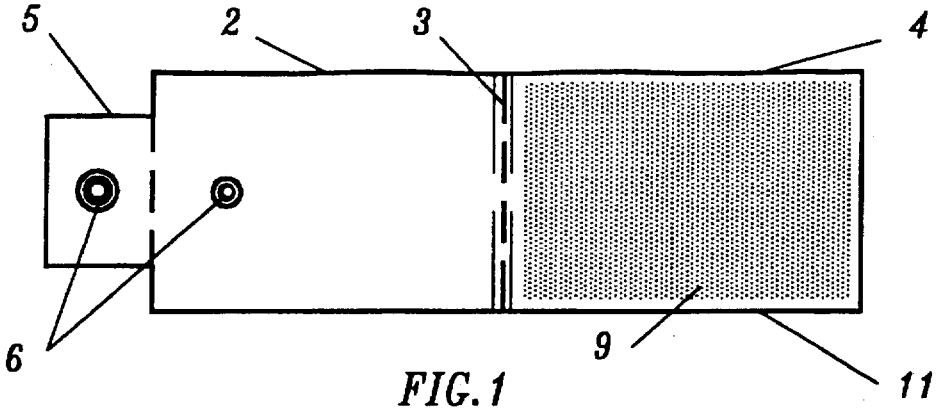
FIG. 1 illustrates an outside plan view of the safety guard.
Figure 2:
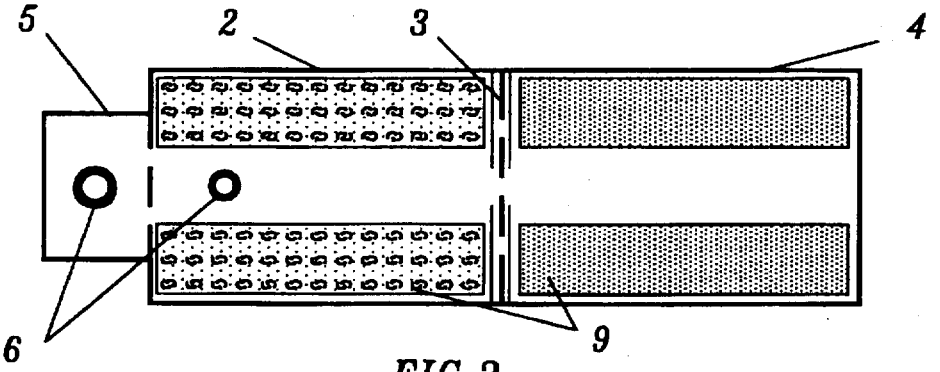
FIG. 2 illustrates an inside plan view of the safety guard.
Figure 3:
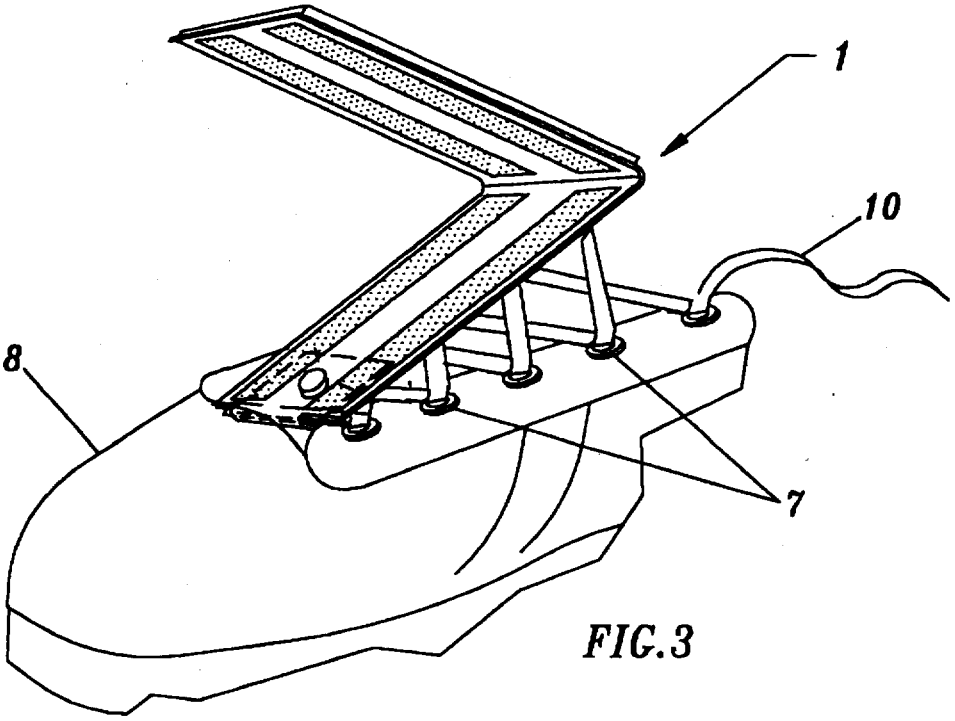
FIG. 3 illustrates a perspective view of the safety guard attached to the shoe lace.
Figure 4:
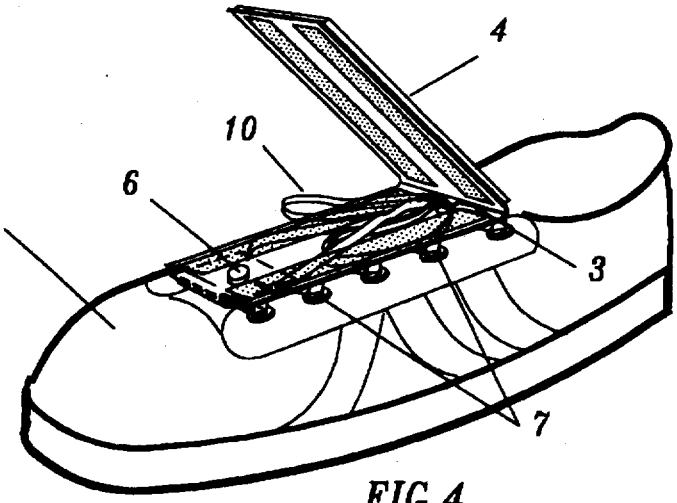
FIG. 4 illustrates a perspective view of the safety guard partially closed with the laces tied in a bow.
Figure 5:
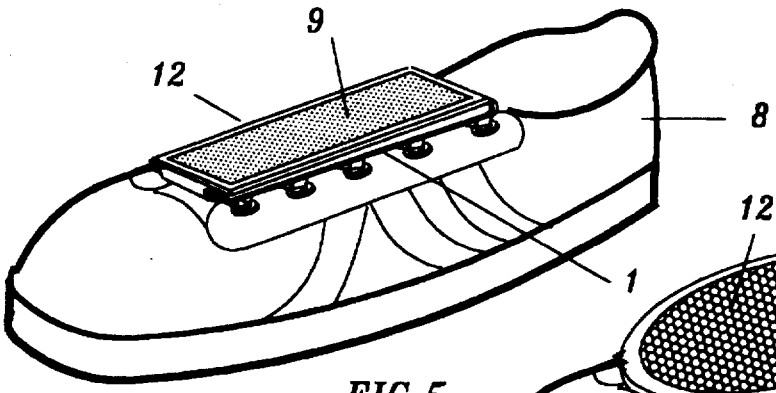
FIG. 5 illustrates a perspective view of the safety guard attached and covering the laces.

As illustrated in FIGS. 3 through 5 the process of attaching the safety guard (1) proceeds first by attachment to an element of the shoe lace (7) using the tab (5) folded and snapped to the inner fastener element (2). The inner fastener element (2) is then rested on the laces (7) and the ends of the shoe lace (7) tied in a typical bow (10) over the inner fastener element (2).

The shoe lace (7) and bow (10) are then placed on the inner fastener element (2) and the outer fastener element (4) is folded over and attached by means of the hook and loop material (9). As illustrated in FIG. 5 this covers and retains the shoe laces (7).

Figure 6:
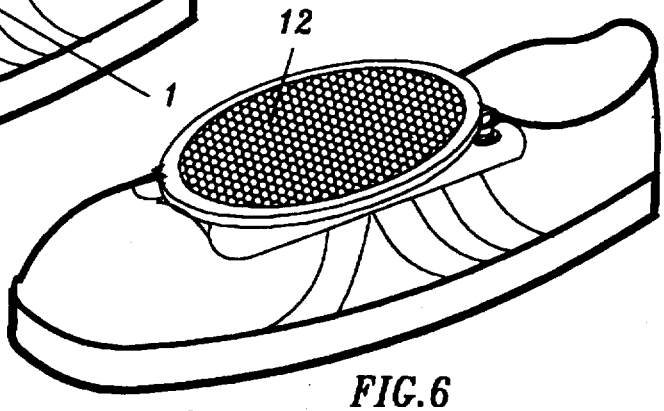
FIG. 6 illustrates a perspective view of a reflector attached to the safety guard.

Referring to FIGS. 5 and 6, the outer surface (11) of the outer fastener element (4) may have hook and loop material (9) for purpose of attachment of an emblem, safety device or other object. A reflective device (12) is illustrated for use in dark conditions to reflect light from automobiles or other light sources.

I claim:

1. A device for attachment to the laces of shoes comprising:

an inner fastener element joined at a fold to an outer fastener element shaped to cover a plurality of laces of a shoe;

an inner surface of the inner fastener element and the outer fastener element have a means for attachment when the inner fastener element and the outer fastener element are folded together;

a tab attached to the inner fastener element at an end opposite the fold wherein the tab and the inner fastener element have a snap cooperatively located for fastening the tab when folded over against the inner fastener element; and the tab and the fold located such that the tab is attachable to the laces opposite the fold wherein a bow formed by tying the laces retains the device at the fold.

2. The device as in claim 1 wherein the means for attachment is a hook and loop material.

3. The device as in claim 1 wherein there is a hook and loop material attached to an outer surface of the outer fastener element.

4. The device as in claim 3 wherein there is a reflector attached to the hook and loop material.

5. The device as in claim 3 wherein there is an emblem attached to the hook and loop material.

6. A device for attachment to the laces of shoes comprising:

an inner fastener element joined at a fold to an outer fastener element shaped to cover a plurality of laces of a shoe;

an inner surface of the inner fastener element and the outer fastener element have a means for attachment one to the other when the inner fastener element and the outer fastener element are folded together;

a tab attached to the inner fastener element at an end opposite the fold wherein the tab is attachable to the shoe by a second means for attachment; and the tab and the fold located such that the tab is attachable to the shoe opposite the fold wherein a bow formed by tying the laces retains the device at the fold.

* * * * *